United States Patent [19]

Wirbilowicz et al.

[11] 3,964,809

[45] June 22, 1976

[54] MODULAR CABINET STRUCTURE

[75] Inventors: Chester Wirbilowicz, Clifton; H. Theodore Young, Union, both of N.J.

[73] Assignee: Becton, Dickinson and Company, East Rutherford, N.J.

[22] Filed: May 21, 1975

[21] Appl. No.: 579,377

[52] U.S. Cl. ..... 312/111; 312/108

[51] Int. Cl.[2] ..... A47B 87/00

[58] Field of Search ..... 312/107, 108, 111, 263

[56] References Cited

UNITED STATES PATENTS

| | | | |
|---|---|---|---|
| 2,929,228 | 3/1960 | Gould, Jr. | 312/108 |
| 3,330,608 | 7/1967 | Drugger, Jr. | 312/111 |
| 3,583,780 | 6/1971 | Berkowitz | 312/108 |
| 3,756,677 | 9/1973 | Grosswiller | 312/108 |

*Primary Examiner*—Casmir A. Nunberg

*Attorney, Agent, or Firm*—Kane, Dalsimer, Kane, Sullivan and Kurucz

[57] ABSTRACT

A modular cabinet structure is provided. The structure includes a first level framework and an identical second level framework. Each of the frameworks includes a rear wall having a pair of sidewalls extending transversely from opposite ends of the rear wall. A pin extends inwardly from at least one of the sidewalls and a locking tab is pivotally mounted to the sidewall by the pin. The tab includes a slot adapted to engage the pin of the other framework to enable the frameworks to be secured to one another.

4 Claims, 4 Drawing Figures

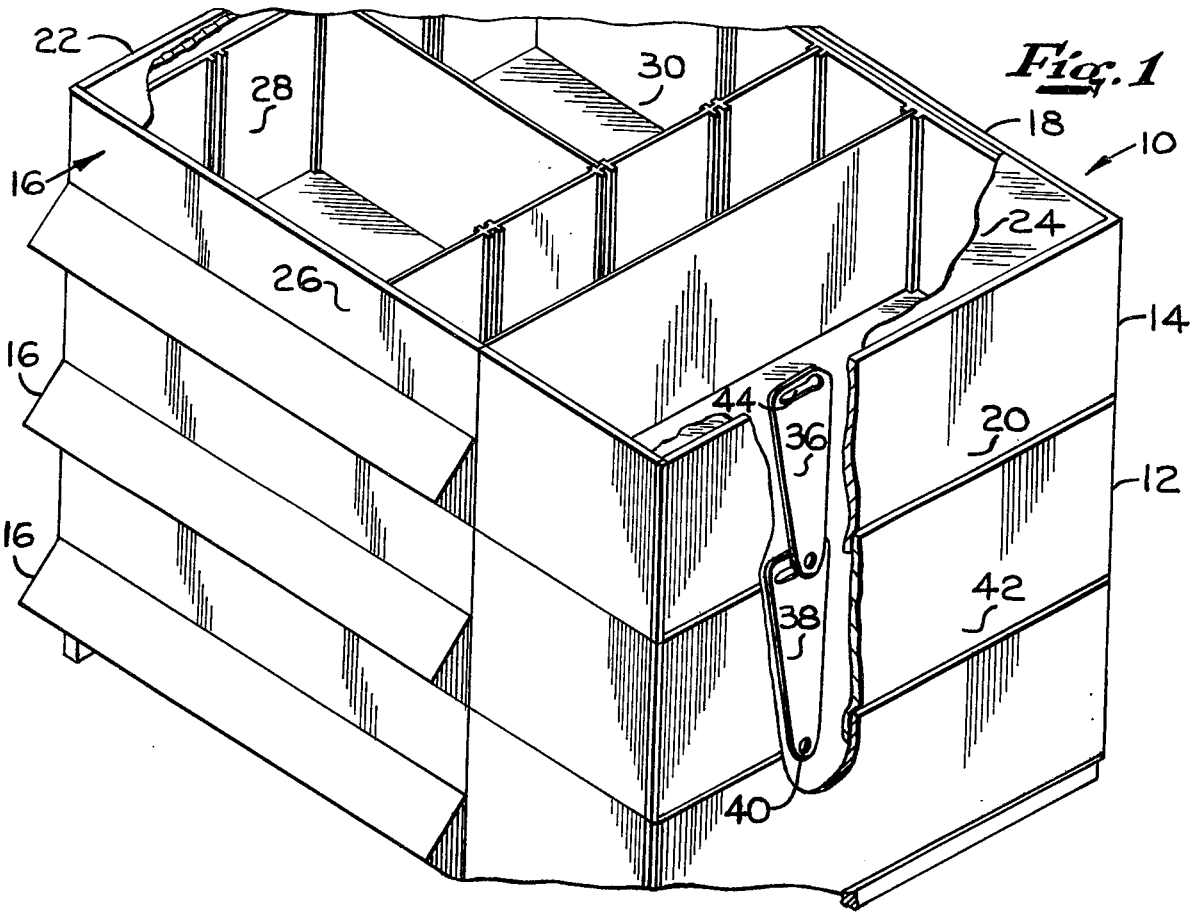
Fig. 1
Fig. 2
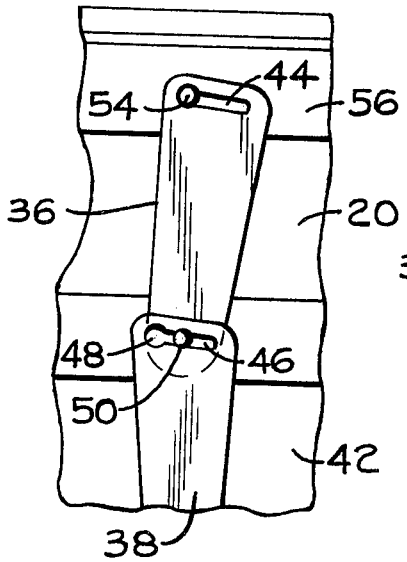
Fig. 3
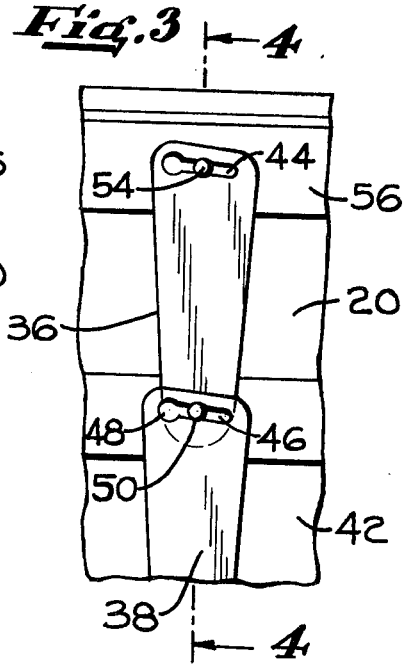
Fig. 4
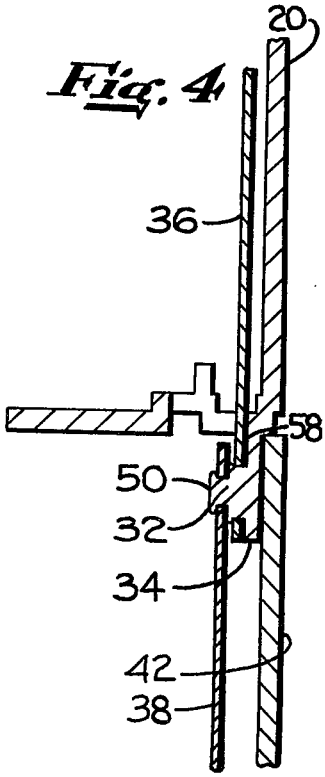

MODULAR CABINET STRUCTURE

BACKGROUND OF THE INVENTION

The present invention relates to a modular cabinet structure and more particularly to a structure containing several levels securely fastened to one another.

There are many applications wherein it is desirable to have a cabinet of flexible capacity. A typical application is a syringe dispenser for a physician's office or hospital. In some cases a single drawer unit is sufficient. In other cases several such drawers are required to meet the needs of the user. It is desirable to enable the drawers to be stacked one on top of another and locked in position.

In view of the above, it is the principal object of the present invention to provide a modular cabinet structure wherein as many units as necessary may be stacked one on top of another and locked to each other to form a single integrated unit.

SUMMARY OF THE INVENTION

The above and other objects and advantages are attained in accordance with the present invention by providing a modular cabinet structure. The structure includes a first level framework and identical second level framework. Each of the frameworks includes a rear wall having a pair of sidewalls extending transversely from opposite ends of the rear wall. A pin extends inwardly from at least one of the sidewalls and a locking tab is pivotally mounted to the sidewall by the pin. The tab includes a slot adapted to engage the pin of the other framework to enable the frameworks to be secured to one another. In this connection, the slot is located so that the frames tighten together as the tab is pivoted.

BRIEF DESCRIPTION OF THE DRAWINGS

In the accompanying drawings:

FIG. 1 is a fragmentary perspective view of a modular cabinet structure in accordance with the present invention partially broken away to more clearly illustrate the interlocking feature;

FIGS. 2 and 3 are fragmentary side elevational views looking outwardly from within the structure depicting the locking mechanism in open and locked position; and, FIG. 4 is a side elevational sectional view taken along reference lines 4—4 of FIG. 3 in the direction indicated by the arrows.

DETAILED DESCRIPTION OF THE PREFERRED EMBODIMENT

Reference is now made to the associated drawings wherein several components bear the same reference numeral throughout the several views. In FIG. 1, a modular structure 10 is shown comprising a plurality of different level frameworks including a first level framework 12 and second level framework 14. Each of the frameworks in effect comprises an open top and front-ended sleeve adapted to receive a drawer assembly 16. Thus, the second level framework 14 includes a rear wall 18 and sidewalls 20 and 22. A partial bottom (not shown) extends inwardly from the sidewalls. A top panel 24 is attached to the top framework to enclose the structure.

Each drawer assembly 16 includes a front panel 26 which extends to the framework side panels as well as side panels 28, rear panel 30 and a bottom panel (not shown).

As stated, the construction of the first framework 12 is identical with that of the second framework 14. Its associated drawer is likewise identical with the drawer associated with framework 14 although, if desired, certain of the drawers may be provided with locks.

Sidewall 20 is provided with an inwardly directed pin 32 adjacent its lower end 34. A similar pin 54 extends from the sidewall 56 of top cover panel 24. A locking tab 36 is pivotally mounted to pin 32. In an identical manner, a locking tab 38 is pivotally mounted to the pin 40 of sidewall 42 of the first framework 12. Tab 36 extends for substantially the entire height of the sidewall and is provided with a slot 44 adjacent its upper end which engages the pin 54 in the cover panel. Similarly, tab 38 is provided with an identical slot 46 which engages the pin 32. Each slot extends generally transversely to the longitudinal axis of the tab and includes an enlarged section 48 the diameter of which is sufficient to enable it to pass through the enlarged head of its associated pin, such as head 50 of pin 32. In this manner, the distance between pins 32 and 54 is reduced as the tab 36 is rotated. Similarly, the distance between pin 32 and the pin (not shown) from the framework 12 below is reduced as tab 38 is rotated.

In use, one framework, such as framework 14, is positioned over another framework, such as framework 12. The pin head is passed through the enlarged portion of the tab slot and the tab is then rotated (as shown by a comparison of the relative positions of tab 36 of FIGS. 2 and 3) to lock in position. Rotation of the tab 36 serves to remove the enlarged portion of the tab slot from the pin head and also provides a camming action to draw the frameworks toward one another. In this manner, the framework may be built as high as required with each level securely fastened to the level below it. Thus, in FIGS. 2 and 3, if cover panel 24 were removed and replaced with additional frameworks, sidewall 20 would be secured by tab 36 to the pin of the sidewall of the level above it and so on.

In order to facilitate mating of the various levels of the structure, each sidewall includes an inwardly stepped lower portion 58 through which the pin 32 extends. Lower portion 58 is stepped inwardly a distance substantially equal to the thickness of the sidewall 20 so that sidewall 42 of the first level is substantially flush with sidewall 20 of the second level as shown in FIG. 4.

To insure the rigid fastening of the various levels of the unit to one another, an identical locking tab arrangement may be provided on the opposite sidewalls.

Thus, in accordance with the above, the aforementioned objects are attained.

Having thus described the invention, what is claimed is:

1. A modular cabinet structure comprising:

a. a first level framework having a rear wall; a pair of sidewalls extending transversely from opposite ends of said rear wall; each of said sidewalls having a lower end and an upper end, a pin extending inwardly from at least one of said sidewalls adjacent one of said ends, a locking tab pivotally mounted to said one sidewall by said pin, and a slot extending through portions of said tab;

b. a second level framework having a rear wall; a pair of sidewalls extending transversely from opposite ends of said rear wall; each of said sidewalls having a lower end and an upper end, a pin extending inwardly from at least one of said sidewalls adjacent one of said ends; said second framework pin having an enlarged head at its inner end and said first framework slot having a first section sufficiently large to receive said pin enlarged head and a second section smaller than said pin head whereby said pin head can pass through said slot first section to be captured by said slot second section to lock said frameworks together; and, c. one of said frameworks being stacked one on top of the other of said frameworks with said first framework lock tab slot engaging said second framework pin whereby to secure said frameworks to one another; said first framework slot defining a camming surface for said second framework pin, whereby rotation of said tab produces a camming action between said slot and pin tending to draw said frameworks toward one another.

2. The structure in accordance with claim 1 wherein said first and second frameworks are identical.

3. The structure in accordance with claim 1 further comprising drawer supporting means extending inwardly from each of said framework sidewalls.

4. The structure in accordance with claim 1 wherein said first level framework pin is adjacent said sidewall lower end and said sidewalls include a lower portion extending downwardly from a line along said pin, said lower portion being stepped inwardly for a distance substantially equal to the thickness of said sidewall.

* * * * *